United States Patent [19]

Klees et al.

[11] Patent Number: 4,566,055

[45] Date of Patent: Jan. 21, 1986

[54] CANDLE HOLDER

[76] Inventors: Gary W. Klees, 9130 SE. 72nd Pl.; Gregory L. Draper, 5340 Lansdowne La., both of Mercer Island, Wash. 98040

[21] Appl. No.: 640,545

[22] Filed: Aug. 14, 1984

Related U.S. Application Data

[63] Continuation of Ser. No. 412,146, Aug. 22, 1982, abandoned.

[51] Int. Cl.[4] ..... F21V 35/00; F21L 19/00

[52] U.S. Cl. ..... 362/162; 362/101; 362/176; 362/178; 362/180; 362/314; 362/445; 362/447; 431/290

[58] Field of Search ..... 362/101, 159, 161-163, 362/171-178, 180, 190, 191, 266, 277, 312-316, 445, 447; 431/289, 290, 291

[56] References Cited

U.S. PATENT DOCUMENTS

| | | | |
|---|---|---|---|
| 46,184 | 1/1865 | Deaus | 362/162 |
| 147,204 | 2/1874 | Walton et al. | 362/162 |
| 273,711 | 3/1883 | Dietz | 362/176 |
| 384,546 | 6/1888 | Stetson | 362/176 |
| 405,106 | 6/1889 | Matthews et al. | 362/176 |
| 471,742 | 3/1892 | Busch | 431/289 |
| 582,838 | 5/1897 | Wilson | 362/161 |
| 719,286 | 1/1903 | Weidig | 362/163 |
| 963,826 | 7/1910 | Stonebridge | 362/162 |
| 964,841 | 7/1910 | Bernau | 362/447 X |
| 1,091,248 | 3/1914 | Sarkadi | 362/161 |
| 1,304,088 | 5/1919 | Patterson | 362/162 |
| 3,867,625 | 2/1975 | Whalen | 362/161 |
| 4,102,323 | 7/1978 | Pritz | 431/290 X |
| 4,186,430 | 1/1980 | Britton | 362/161 X |

FOREIGN PATENT DOCUMENTS

| | | | |
|---|---|---|---|
| 636173 | 2/1962 | Canada | 362/162 |
| 92752 | 6/1896 | Fed. Rep. of Germany | 362/163 |
| 416100 | 7/1925 | Fed. Rep. of Germany | 362/163 |
| 991083 | 6/1951 | France | 362/162 |

*Primary Examiner*—David H. Brown
*Assistant Examiner*—John E. Griffiths
*Attorney, Agent, or Firm*—Seed and Berry

[57] ABSTRACT

An improved candle holder in which the lens is trapped within elastic elongated bars that space the lens from the rigid metallic cover and frictionally hold the lens in an extended and retracted position. Viewing windows are provided for seeing the height of the unburned candle. A brandy glass attachment is provided for the top of the holder.

11 Claims, 5 Drawing Figures

CANDLE HOLDER

This application is a continuation of U.S. patent application Ser. No. 412,146, filed Aug. 22, 1982, now abandoned under C.F.R. §1.62.

DESCRIPTION

1. Technical Field

This invention pertains to portable candle holders.

2. Background Art

Portable candle holders have been known for some time. Difficulties in using such holders are, however, that the glass lens is susceptible to heat and shock breakage, and the cover, which is generally a metallic cover, frequently becomes too hot to handle and does not provide a stable base for the holder. Furthermore, in prior art candle holders, the construction techniques have caused them to have high manufacturing costs.

U.S. Pat. Nos. 4,186,430; 1,091,248 and 1,304,088 describe such conventional candle holders. The holder of U.S. Pat. No. 1,091,248, for example, has a telescopic cover making it top-heavy and unstable. The holder of U.S. Pat. No. 1,304,088 is similar and further has undesirable high-conductivity heat paths to the base. The holder of U.S. Pat. No. 4,186,430 is expensive to manufacture and has a reflector that transmits heat to the base. The elastomeric cover and candle receiver of this patent are highly susceptible to damage if a candle gets stuck and the elastomers are exposed to the 1800°–2200° F. heat from the candle flame.

DISCLOSURE OF INVENTION

It is an object of this invention to provide an improved candle holder which provides better heat resistance for the cover and better shock-resistance protection to the glass lens.

It is another object of this invention to provide an improved candle holder which is easy to manufacture and use.

It is still another object of this invention to provide a unique attachment for a portable candle holder for heating the contents of a liquid container.

Basically, these objects are obtained by mounting the lens within a plurality of circumferentially spaced, elongated elastic bars. These bars are frictionally coupled to the holder for holding the lens in extended and retracted positions, and cushion the lens within the cover for impact resistance. The candle holder, in the preferred embodiment, is provided with a candle receiver which has a candle viewing slot to determine the height of the remaining candle and is held in alignment with a candle viewing window positioned in the rigid external cover.

The candle holder is very easy to use in that the lens can be raised or retracted simply by overcoming frictionally held detents, and yet the candle burns with good combustion characteristics. The bars uniquely allow the heat to be dissipated and do not provide a high-conductivity path back down to the cover, so the cover remains relatively cool, even though the upper part of the lens and bars are heated by the candle flame.

BEST MODE FOR CARRYING OUT THE INVENTION

Figure 1:
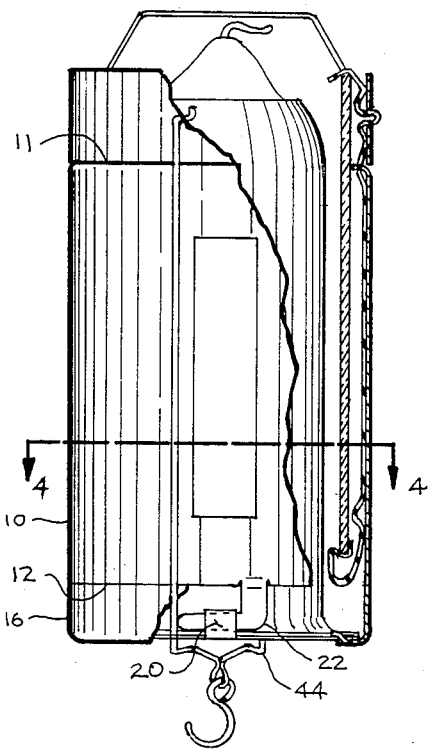
FIG. 1 is a front elevation with parts broken away for clarity of the improved candle holder.

As best shown in FIG. 1, the candle holder is provided with a rigid metallic cover 10 having an upper end 11 and a lower end 12. Fitted within the cover is a receiver 14 in which is slidably positioned a candle 15. The receiver is provided with a lower cap 16 having a spring 18 which pushes the candle upwardly in the receiver. The lower cap is also provided with a plurality of loops 20 which slide over a plurality of prongs 22 fastened to the lower end of the cover.

The loops and prongs are positioned so as to radially align a candle viewing slot 23 in the candle receiver 14 with a candle viewing window 24 in the rigid cover. In the embodiment illustrated, there are three equidistantly spaced candle viewing slots in the candle receiver and three sets of loops and prongs 20 and 22 so that the candle receiver can be placed in any one of three positions within the cover and there still will be radial alignment between the candle viewing window 24 and one of the candle viewing slots 22.

The cover is provided at its upper end with three equidistantly, circumferentially spaced notches 26. Positioned within these notches are elongated, metallic, elastically deformable bars 28, each having an upper end **28*a* and a lower end 28*b* that respectively resiliently trap and hold the upper and lower portions of a glass lens 30 adjacent the ends of the lens. The upper ends of the bars also fit within holes in three equidistantly spaced webs forming part of a heat-dissipating shield 32. The upper ends 28*a* of the bars loosely hold the heat-dissipating shield onto the upper portion of the glass lens 30. Between the webs 29**, the area between the heat dissipating shield and the upper portion of the lens is open for heat dissipation.

Surrounding the upper ends of the bars is a metal lock ring 40 that is retained onto the glass lens by the protrusions 42 in each of the elongated bars. The metal ring also supports a bail 44 which can hold the candle holder in a suspended position and which, when retracted, is formed of a sufficient resiliency and length to fold over the end cap 16 to assist in holding the lens in its retracted position.

Figure 3:
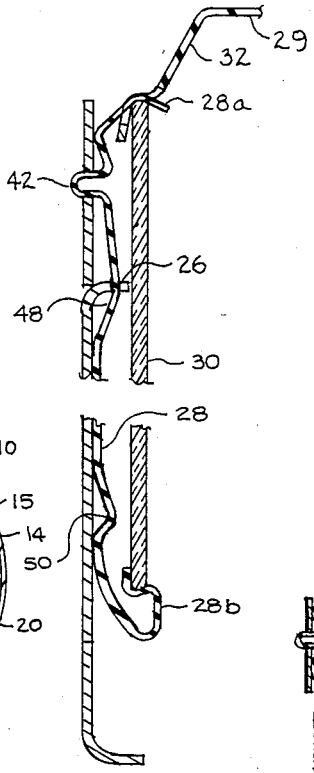
FIG. 3 is a fragmentary enlarged schematic illustrating a portion of the holder shown in FIG. 1.
Figure 2:
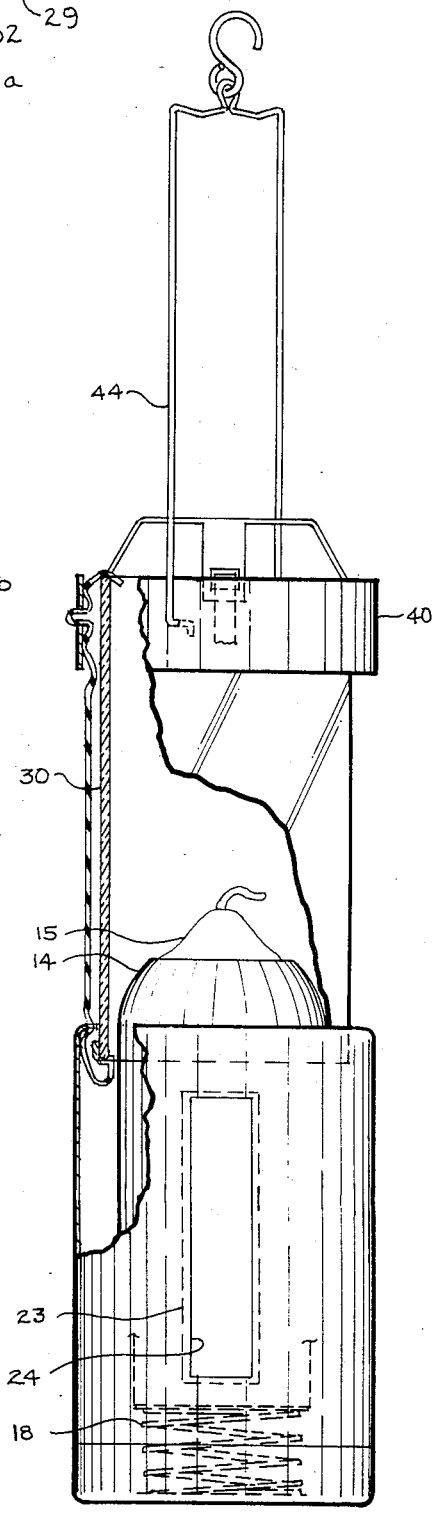
FIG. 2 is a view similar to FIG. 1, but with the candle glass lens in an extended operating position.

The elongated bars form part of a coupling frame for the lens and are uniquely provided with upper detents 48 and lower detents 50. The bars are also elastically pushed radially outwardly at their central portion against the cover. The detents interact with the notches 26 of the upper end of the cover and are resiliently latched thereto in their fully extended or fully retracted position. That is, in the retracted position shown in FIG. 1, the detent 48 is engaged by the notches 26 holding the lens within the cover. In the position as shown in FIG. 2, however, the detent 50 is frictionally engaged with the notch 26 to hold the lens in its extended position. The further unique advantage of the elastic bars 28 is that in the retracted position, as shown in FIGS. 1 and 3, the bars elastically suspend the glass lens 30 within the cover so that it is cushioned against impacts should the cover be bumped or dropped.

As is readily understood, since the bars trap the glass and are circumferentially guided by the notches 26, the bars maintain a predetermined alignment of the lens circumferentially within the cover. Furthermore, since the connection between the lens and the cover is solely through point contact of these three bars, there is a very limited heat-conductivity path available to transfer the heat from the candle flame back down into the cover. This poor conductivity path, plus the airflow passages between the metal ring 40 and the lens, coupled with the ample cooling and combustion air supply entering through the viewing window 24 and gap between the lens and cover, give highly desirable airflow over the lens for reducing the heat in the glass.

Figure 5:
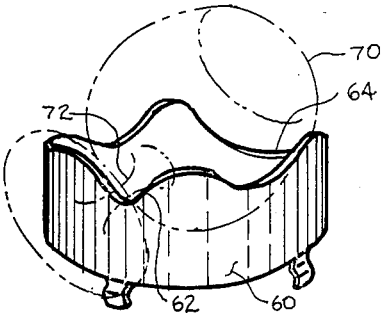
FIG. 5 is an isometric of an attachment for the candle holder shown in FIG. 1.
Figure 4:
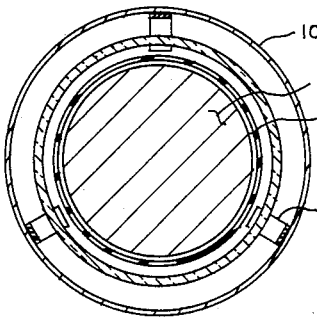
FIG. 4 is a diametrical section taken along the line 4—4 of FIG. 1.

As best shown in FIGS. 1 and 5, an adaptor ring or glass holder 60 has tabs that frictionally fit into the metal ring 40 and is provided with an upper rim having a pair of diametrically opposed notches 62,64. One of the notches, such as 62, is smaller than notch 64. These notches are intended to hold the stem 72 and liquid receptacle portion 70 of a stemmed glass. The smaller notch 62 holds the stem 72 of the glass, and the larger notch 64 holds the receptacle portion. The two notches position the glass at a slight angle so as to hold the contents from spilling, but expose the receptacle to the heat from the candle.

As is readily apparent, the candle holder is very attractive, functionally easy to use, and safe to use.

While the preferred embodiments of the invention have been illustrated and described, it should be understood that variations will be apparent to one skilled in the art. Accordingly, the invention is not to be limited to the specific form illustrated in the drawings.

We claim:

1. A portable candle holder comprising:

an outer rigid cover having upper and lower ends, said upper end having at least three circumferentially spaced alignment notches;

an inner candle receiver coupled to said cover;

means for pushing a candle upwardly in said candle receiver;

a glass lens having upper and lower portions including upper and lower ends;

a heat shield overlying and engaging the upper end of said lens for dissipating the heat from a candle flame;

means for securing a bail to said holder; and coupling means for positioning said lens telescopically between retracted and extended positions within and extending out of said cover, respectively, said coupling means including at least three circumferentially spaced, metallic, flexible, elastic bars, each of said bars having an upper end and a lower end, said upper bar ends pressing directly down on said lens upper end, said lower bar ends pressing directly upon said lens lower end, said bars spaced from said lens at all other locations, said bars extending radially outward against, being frictionally engaged within and telescopically guided by said cover notches to prevent circumferential rotation of the bars and the lens with respect to the cover and for holding said lens at least in said axially extended and retracted positions above and within said cover, respectively, said cover spaced from said bars at all other locations when in the extended position, limiting structural heat-conductive paths to transfer heat from the lens to the cover through the bars.

2. The holder of claim 1, said candle receiver having a candle viewing slot, said cover having a candle viewing window, said candle receiver having a bottom cap for covering the lower end of the cover, and fastening means for releasably holding the bottom cap to said cover and for positioning the viewing window in alignment with said candle viewing slot.

3. The candle holder of claim 1, said means for securing a bail to said holder including a ring fastened to said bars, said ring being radially spaced from said lens to provide an air cooling slot around said glass lens upper portion.

4. The holder of claim 1, including an adaptor ring coupled to said holder and extending axially upward therefrom and having an upper rim provided with diametrically aligned notches adapted to hold the stem and fluid receptacle of a stemmed glass in position above said heat shield.

5. The candle holder of claim 1, each said bar having an upper and lower radially depressed detent, said lower detent engaging the upper end of said cover to hold said lens in its extended position, said upper detent engaging said cover for holding said lens in said retracted position, said bars having an elongated central elastic portion spaced from said lens and engaging said cover for resiliently spacing the lens from the cover to protect the lens against impacts.

6. The holder of claim 5, said means for securing a bail to said holder including a ring fastened to said bars, said ring being radially spaced from said lens to provide an air cooling slot around said glass lens upper portion, and said lens being radially spaced from the cover and from said candle receiver for providing air combustion and air cooling passages surrounding said lens.

7. A portable candle holder comprising:

an outer rigid cover having upper and lower ends, said upper end having a plurality of equidistantly and circumferentially spaced alignment notches;

an inner candle receiver coupled to said cover;

means for pushing a candle upwardly in said candle receiver;

a glass lens having upper and lower ends;

a heat shield overlying the upper end of said lens for dissipating the heat from a candle flame;

means for securing a bail to said holder; and a coupling frame positioning said lens telescopically within said cover, said coupling frame including a plurality of equidistantly and circumferentially spaced, metallic, flexible, elastic bars extending radially outward into engagement with said cover to resiliently cushion and support the lens in the cover, each of said bars having an upper end and a lower end, said upper bar ends pressing directly down on said lens upper end, said lower bar ends pressing directly upon said lens lower end, said bars spaced from said lens at all other locations, and said bars being frictionally engaged within said cover notches for preventing circumferential rotation of the bars and the lens with respect to the cover, said cover spaced from said bars at all other locations when in the extended position, limiting structural heat-conductive paths to transfer heat from the lens to the cover through the bars, said upper and lower bar ends being the sole support for the lens, suspending the lens in said retracted and extended positions, and said cover engaging said bars in the retracted position to resiliently cushion the lens within said cover against impacts.

8. A portable lantern comprising:

an outer rigid cover having upper and lower ends, and a bail for suspending the lantern;

an inner flame light-source receiver adapted to carry a flame light-source;

a glass lens having upper and lower portions including upper and lower ends;

a heat shield overlying the upper end of said lens for dissipating heat from a flame light-source within the receiver, and means supporting the heat shield over said lens;

at least three circumferentially and equidistantly spaced, flexible, elastic bars for suspending the lens in the cover, each of said bars having an upper end and a lower end, said upper bar ends pressing directly down on said lens upper end, said lower bar ends pressing directly upon said lens lower end, said bars spaced from said lens at all other locations, said bars extending radially outwardly against said cover for resiliently cushioning said lens against impacts, and said bars being telescopically received in said cover and frictionally engaged by said cover for positioning the lens between extended and retracted positions axially beyond and within said cover, respectively; and said cover having guide means for guiding the bars along straight axial paths as they are telescoped outwardly to maintain relative rotational positioning between the bars and the cover, said guide means being notches which frictionally receive the bars, said cover spaced from said bars at all other locations when in the extended position, limiting structural heat-conductive paths to transfer heat from the lens to the cover through the bars, said upper and lower bar ends being the sole support for the lens, supporting the lens in said retracted and extended positions, and said cover engaging said bars in the retracted position to resiliently cushion the lens within said cover against impacts.

9. The lantern of claim 8, said flame light-source being a candle, and means within said receiver for biasing said candle axially outward toward the upper end of said receiver.

10. The lantern of claim 8 wherein said means supporting the heat shield includes a locking ring joined to said bars, said bail being connected to said locking ring, said locking ring being held spaced from said lens by said bars.

11. The lantern of claim 10, said locking ring having apertures for receiving said bars, said bars having bends protruding into said locking ring apertures for supporting said locking ring on said bars.

* * * * *